US006880233B2

(12) United States Patent
Gerber et al.

(10) Patent No.: US 6,880,233 B2
(45) Date of Patent: Apr. 19, 2005

(54) METHOD OF MAKING AN AIR BAG

(75) Inventors: George V. Gerber, Bonita, CA (US); Anthony E. Troianello, Santa Ana, CA (US); Haim Goldberger, Holon (IL)

(73) Assignee: Vishay Intertechnology, Inc., Malvern, PA (US)

( * ) Notice: Subject to any disclaimer, the term of this patent is extended or adjusted under 35 U.S.C. 154(b) by 498 days.

(21) Appl. No.: 10/079,176

(22) Filed: Feb. 20, 2002

(65) Prior Publication Data

US 2002/0097139 A1 Jul. 25, 2002

Related U.S. Application Data

(62) Division of application No. 09/765,901, filed on Jan. 19, 2001, now Pat. No. 6,680,668.

(51) Int. Cl.[7] ..... H01C 17/28

(52) U.S. Cl. ..... 29/619; 29/610.1; 29/611; 29/620; 102/202.5; 102/202.7; 338/307; 338/309

(58) Field of Search ..... 29/619, 610.1, 29/611, 620; 102/202.5, 202.7; 338/307, 309

(56) References Cited

U.S. PATENT DOCUMENTS 4,944,225 A 7/1990 Barker
4,976,200 A 12/1990 Benson et al.
5,080,016 A 1/1992 Osher
6,230,624 B1 * 5/2001 Chatley et al. ..... 102/202.7
6,305,286 B1 * 10/2001 Fogle et al. ..... 102/202.5
6,324,979 B1 * 12/2001 Troianello ..... 102/202.7

FOREIGN PATENT DOCUMENTS

DE 199 17 236 A1 10/1999
DE 199 50 854 A 1 5/2000

* cited by examiner

*Primary Examiner*—Carl J. Arbes
*Assistant Examiner*—Tim Phan
(74) *Attorney, Agent, or Firm*—McKee, Voorhees & Sease, P.L.C.

(57) ABSTRACT

A fast heat rise resistor comprising a substrate, a foil bridge on the surface of the substrate, the foil bridge having an elevated portion and a contact portion, the elevated portion above the substrate, the contact portion in contact with the substrate, a conductive layer attached to the contact portion of said foil bridge. The activation energy and/or response time is reduced as the foil bridge is suspended over the substrate. Another aspect of the invention include a method of manufacturing the foil bridge and application to autoignition vehicle airbags.

6 Claims, 3 Drawing Sheets

METHOD OF MAKING AN AIR BAG

CROSS-REFERENCE TO RELATED APPLICATION

This application is a divisional of Ser. No. 09/765,901 filed Jan. 19, 2001 now U.S. Pat. No. 6,680,668.

BACKGROUND OF THE INVENTION

A. Field of the Invention

This invention relates to a method and apparatus for a fast heat rise resistor that can be used as a resistive igniter. More particularly, this invention relates to the use of resistive foil and photolithographic production to produce a fast heat rise resistor, the resistor suitable for use as an igniter in autoignition-deployed safety devices.

B. Problems in the Art

There are numerous needs for fast heat rise resistors. One such need relates to the use of a resistor as an igniter used to ignite a pyrotechnic or other explosive material. In these resistive igniter applications, it is desirable that the resistive igniter act quickly for rapid ignition. One such application is in vehicle airbag inflators where it is crucial that an igniter act quickly to ignite a gas-generating pyrotechnic in order to ensure that an air bag is deployed in a timely fashion. As the resistor is driven by current, the heat of the resistor increases to a point where other material such as pyrotechnic material can be ignited. There are numerous other applications of resistive igniters, including in other auto-ignition devices such as seatbelt pretensioners, battery cable disconnects, fuel line shut off devices, roll bars, safety devices, and other applications.

There have been attempts made at a resistive igniter in the prior art. Previous attempts have been made that have used metal wire or film bridges. In metal wire or bridgewire devices, a metal filament also known as a bridgewire is used. Some problems with bridgewire devices involve the difficulties involved in manufacturing bridgewires. In order to predict performance of a bridgewire, there must be uniform thermal and electrical properties. Problems remain in manufacturing bridgewires of the needed uniformity.

Another problem with bridgewire devices is that the response time is too slow or else too much activation energy is required. This is problematic where a fast response time is needed or else there are limited power resources that can not support large activation energies. One example of a situation where there are limited power resources is in a vehicle where a 12 volt battery is used to activate an igniter.

Yet another problem with bridgewire devices involves reliability. In bridgewire devices pyrotechnic powder is pressed against the bridgewire. This process can result in detachment of the bridgewire. Thus there are reliability problems with bridgewires as well.

Other attempts at creating resistive igniters have used metal film bridges that are either thin film or thick film. One problem with a thick film or thin film approach is the increased cost of manufacturing associated with these approaches, and in particular with the thin film approach. Another problem with a metal film approach is that there is contact between the metal film bridge and a substrate. This contact between the metal film bridge and the substrate results in a loss of heat from the metal film bridge to the substrate, resulting in an increase in the amount of time for the metal film bridge to reach a particular temperature or alternatively, an increase in the amount of current required in order for the metal film bridge to reach a particular temperature in a given time.

Another problem with film bridges relates to their reliability. Pyrotechnic powder is pressed against the bridge, however, this powder may become displaced during handling. Thus, the pressed powder may or may not constantly touch the wire or film. Where a liquid pyrotechnic is used, the same contact problems may also arise, as the liquid pyrotechnic may not be in constant contact with the wire or film. These problems result in an igniter that is not reliable.

Thus there is a need for a reliable heat rise resistor which has fast response and can be manufactured in a uniform fashion. There is a further need for a heat rise resistor that can be easily packaged and delivered to customers.

Thus, it is a primary object of the present invention to provide an igniter which improves upon the state of the art.

Yet another object of the present invention is to provide an igniter with a fast response time.

Another object of the invention is to provide an igniter that is reliable.

It is another object of the present invention to provide an igniter that requires decreased activation energy.

Yet another object of the present invention is to provide an igniter that can be manufactured uniformly.

Another object of the present invention is to provide an igniter suitable for use in auto-ignition safety devices.

A still further object of the present invention is to provide an igniter suitable for use in an airbag deployment system.

Yet another object of the present invention is to provide a fast heat rise resistor that does not lose heat to a substrate.

It is another object of the present invention to provide a fast heat rise resistor and method of making a fast heat rise resistor that can be easily packaged and distributed.

A still further object of the present invention is to provide a resistor capable of having all of its sides in contact with a pyrotechnic.

These and other objectives, features, or advantages of the present invention will become apparent from the specification and claims.

SUMMARY OF THE INVENTION

This invention describes a method and apparatus for a fast heat rise resistor using resistive foil with photolithographic production. The invention provides for a fast heat rise resistor that results in a fast response and is suitable for use as an igniter to ignite pyrotechnic material.

DESCRIPTION OF THE PREFERRED EMBODIMENT

Figure 1:
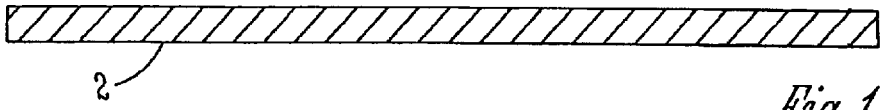
FIG. 1 is a cross-sectional diagram of the substrate of the resistor.

With reference to the drawings, the same reference numerals or letters will indicate the same parts or locations throughout the drawings unless otherwise indicated.

Method of the Invention

The steps of creating a fast heat rise resistor according to the present invention are shown in detail in the drawings. FIG. 1 shows a substrate 2. The substrate may be a polyimide substrate or other substrate such as are well known in the art. The layer of polyimide has a thickness of approximately two mil. The polyimide is preferably fully cured and surface etched. The present invention contemplates that the layer of polyimide may be a sheet of convenient size such as one that is 4 inches by 5 inches, or other standard or convenient size.

Figure 2:
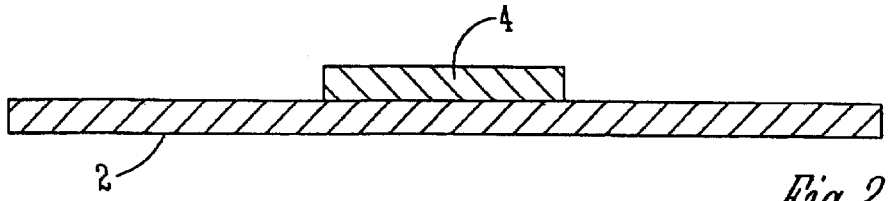
FIG. 2 is a cross-sectional diagram depicting the substrate with capton layered on top.

In the next step, as best shown in FIG. 2, a layer of material such as capton 4, is bonded or otherwise attached to the substrate 2. The present invention is not limited to capton and contemplates that other types of material such as photoresistive film may be used in place of capton.

A photoresistive step is then applied to print a pattern on the capton and to then develop the capton so as to leave a series of stripes of capton on the polyimide. The present invention contemplates that stripes of different dimensions may be used. The present invention further contemplates that film can be bonded in stripes as well such that the photoresistive step is not required, even though the photoresistive print and develop step provides a convenient method of obtaining the capton stripes. Stripes of 20 mils can be placed every 60 mils across the long dimension of the polyimide. It is to be appreciated that other configurations and dimensions of stripes can be used and the present invention contemplates these and other variations.

Figure 3:
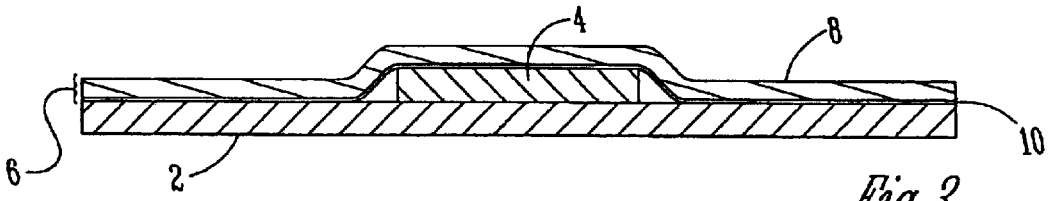
FIG. 3 is a cross-sectional diagram showing a substrate, capton layer, and copper-plated foil.

As shown in FIG. 3, copper plated foil 6 is applied over the layer of capton 4 and the substrate 2. The copper plated foil has a copper side 8 and a foil side 10. The foil used may be a Ni/Cr foil or other foil as may be known in the art. The copper plating is of a thickness of 1 mil, or of other thickness as required by the particular application of the resistor. The foil is of a thickness of 0.1 mil. The present invention contemplates other thicknesses of foil and copper plating. The selection of the foil material and of the thickness of the foil should be made so as to reflect the properties desired in the resulting resistor including the activation time and activation energy required. These requirements will be discussed later in the context of an exemplary embodiment of the fast heat rise resistor apparatus.

Figure 4:
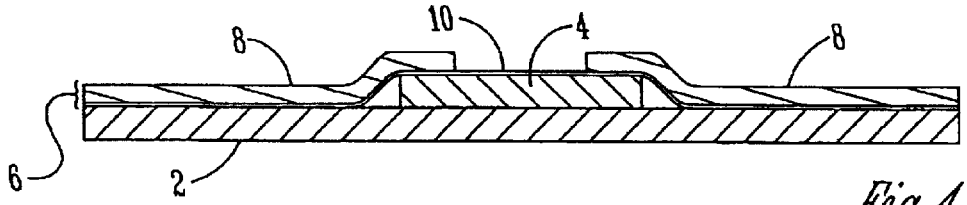
FIG. 4 is a cross-sectional diagram showing the resistor after the copper-plated foil has been preferentially dissolved away.

A first etching step is then applied to the resistor of FIG. 3. Through a Kodak® photo resistive process (KPR) or other photolithography process, a defined length of foil is printed on the copper side 8 of copper plated foil 6. The printing on copper plated foil 6 defines a length of the resistors in the array. The length of the resistor path may be 20 mils at this point, although the present invention contemplates other variations. After this printing and developing, the copper is then preferentially etched away, leaving the portion desired. The resistor after the etching step is applied is best shown in FIG. 4. As FIG. 4 shows, the foil 10 is now exposed as the layer of copper on the foil 8 has been preferentially etched away.

Figure 5:
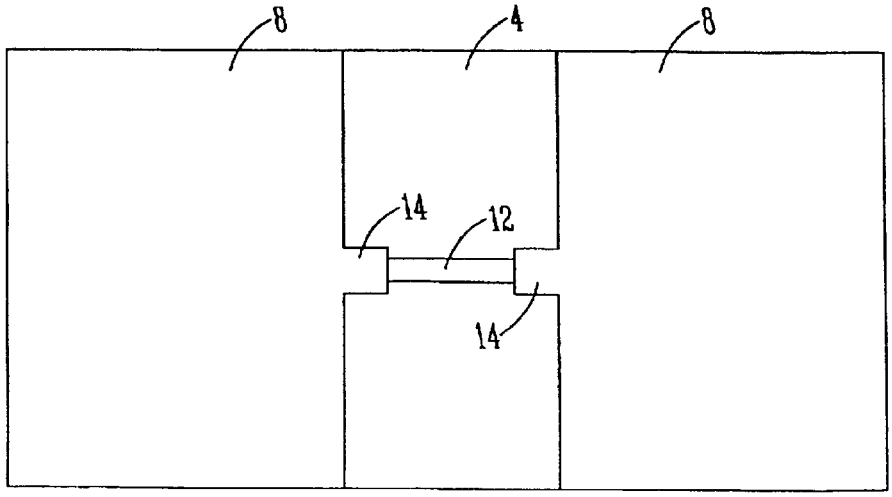
FIG. 5 is a top view depiction of the resistor after excess foil has been dissolved away.
Figure 6:
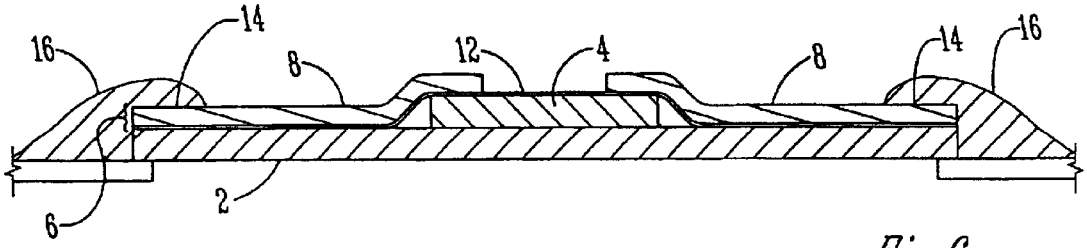
FIG. 6 is a cross-sectional diagram after the excess foil has been dissolved away.

A second print and etching step is then applied. In this step, the foil 10 is printed on to expose a defined width of the resistor trays. The present invention contemplates various widths of the traces but 1 mil is preferable. The high resistivity of foil 10 increases the amount of heat generated when current is passed through trace 10. The heat generated further increases as the width of foil 10 is reduced. The resulting resistor is shown in FIG. 5. As shown in FIG. 5, the foil trace 12 is still attached to the capton 4 and electrically connected between the copper terminals 14. FIG. 6 shows a perspective view of the resistor after this step has been completed. The resistive trace 12 of the foil remains attached to the capton and electrically connected between the copper terminals 14.

Figure 9:
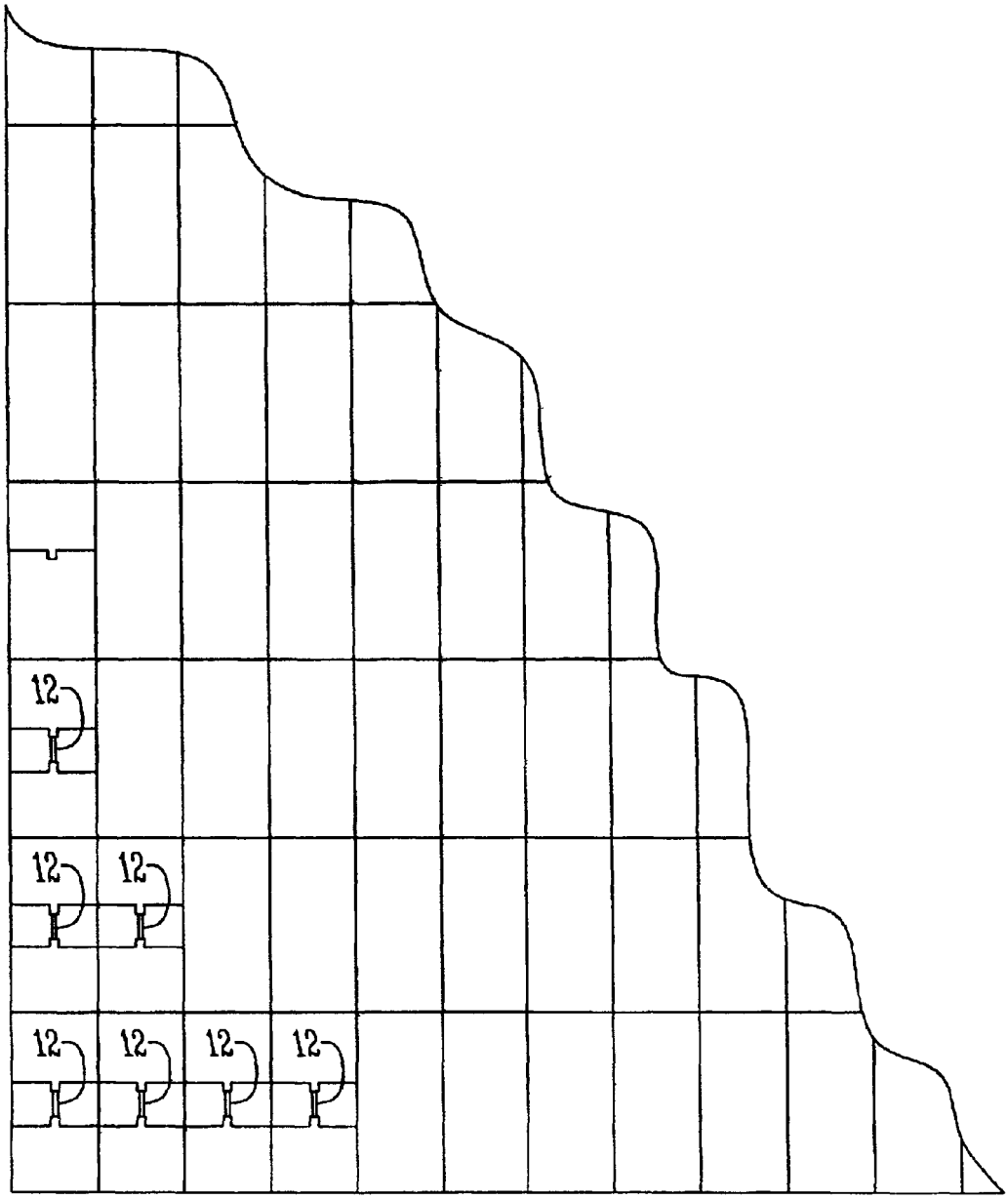
FIG. 9 is a top view of the step and repeat array of resistors.

It is to be appreciated that many such resistors of the present invention may be manufactured at the same time. This is shown best in FIG. 9. In FIG. 9, a step and repeat array of resistors is shown prior to singulation. The resistors can then be singulated for shipping to customers. The capton 4 is still a part of the resistor at this point. Capton 4 provides stability to the foil traces 12. This reduces or eliminates the possibility of foil traces 12 breaking or otherwise being damaged in transit.

Figure 7:
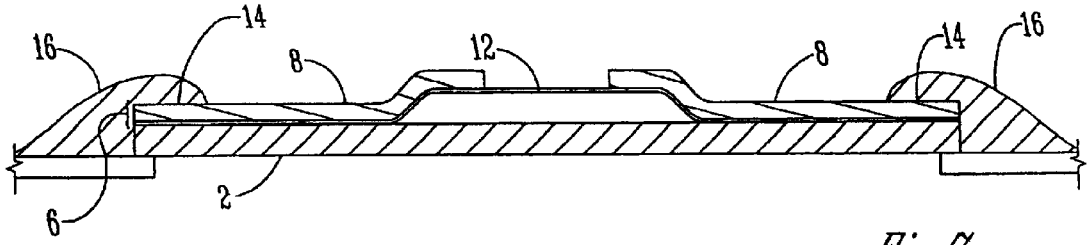
FIG. 7 is a cross-sectional diagram after capton has been removed.

Prior to use, capton 4 can optionally be dissolved or otherwise removed resulting in the resistor best shown in FIG. 7. This removal may be through application of a chemical solvent. The present invention also contemplates that the capton 4 is not removed. The resistor is then mounted onto the squib and connected to posts. This connection may be made by soldering the resistor in place, applying a conductive epoxy, welding the resistor in place, or other means such as are well known in the art.

In this resistor, foil trace 12 is suspended between the copper terminals on copper plating 8. Thus, when current is passed through the resistor from terminal to terminal, the foil trace 12 will quickly increase in temperature. This increase in temperature is due to the material used for the foil trace 12, the width of the foil trace, and the fact that as the foil trace is not in physical contact with substrate 2, heat is not absorbed by substrate 2.

Figure 8:
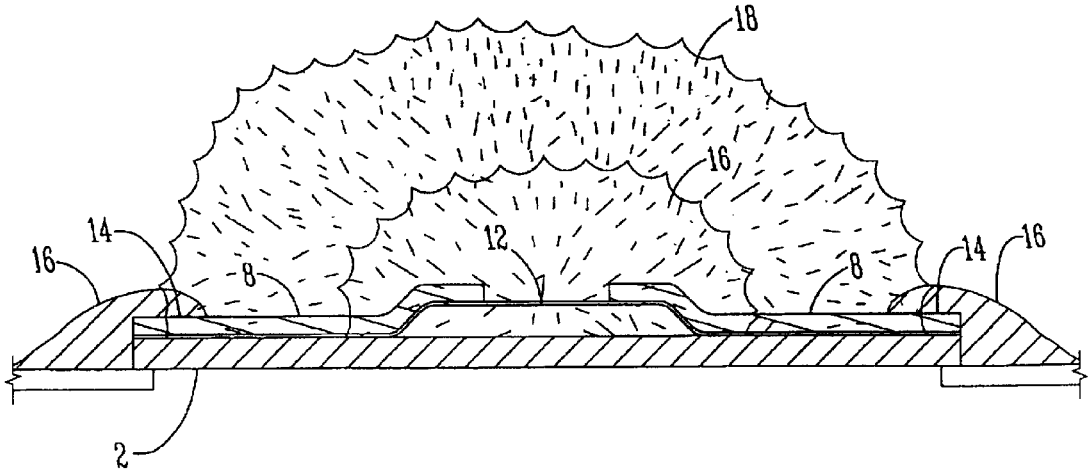
FIG. 8 is a cross-sectional diagram showing the resistor and pyrotechnic.

The customer may include the resistor of the present invention in applications where the resistor serves as an igniter. This is shown best in FIG. 8 where the resistor is surrounded by a first pyrotechnic material 16 and a second pyrotechnic material 18. Because the foil resistor is suspended, the pyrotechnic material can completely surround the foil resistor. As the foil resistive trace 12 is not attached to a substrate, heat is not absorbed by the substrate due to conduction. As resistor 12 heats, pyrotechnic material 16 is ignited. This results in an explosion which can be used to ignite the second pyrotechnic material 18. One example where this configuration can be used is in an air bag. In an air bag, a current passed through a resistor can be used to ignite a first pyrotechnic 16 which in turn ignites a gas-generating pyrotechnic material 18 which can inflate an air bag. In such application, it is important that the air bag is inflated as quickly as possible thus the fast rising action of resistor 12 is desirable.

Apparatus of the Invention

The apparatus of the present invention is best shown in FIG. 7. The fast heat rise resistor includes a polyimide substrate 2. On top of substrate 2 is capton 4. The capton is used to secure the resistive trace 12 in place during handling and shipping to a customer. Resistive trace 12 is a foil trace preferably of Ni/Cr, but may be of other types of foil as requirements of the heat rise resistor may require. The foil trace 12 is elevated above the substrate 2 as the foil trace 12 is on top of the capton layer 4. The resistor also has a top layer 8 of copper plating on the copper plated foil 6. The underside of the copper plating foil is foil and that portion of the foil that extends across the gap is the resistive trace 12. The resistor is secured in place onto a circuit board or other structure through soldering with solder 16 onto solder pad 14. The present invention contemplates that the resistor may be mounted by other methods such as conductive epoxy or welding.

FIG. 7 best shows the resistor after the layer of capton 4 has been removed. When the layer of capton 4 is removed, such as by application of a chemical solvent, the foil trace is suspended over substrate 2. This results in the heat of foil 12 increasing more rapidly as current is passed through the resistor. As the foil trace 12 is not in physical contact with substrate 2, heat is not absorbed by the substrate 2 which would increase the time that it would take for a given current passed through the resistor to cause foil trace 12 to reach a particular temperature. The apparatus of the present invention is shown in one environment in FIG. 8. In this environment, the resistor is surrounded by pyrotechnic material 16. Thus, when foil trace 12 reaches a particular temperature, pyrotechnic material 16 is ignited. The ensuing explosion serves to ignite a gas generating pyrotechnic 18. The amount of time that is needed to ignite is reduced because the foil trace 12 is heated more thickly than in the prior art. The present invention also contemplates that the capton 4 need not be removed. As Capton 4 has thermal diffusivity lower than a ceramic substrate, even with capton 4 in place, improvement in rise time is achieved. When the capton remains in place, pressed powder can surround the resistor.

Due to the fast rise time and reliability, the present invention contemplates use in a variety of applications, including, without limitation, auto-ignition applications, safety applications, airbags, seat belt pretensioners, battery cable disconnects, fuel line shut off devices, roll bars, and numerous other uses.

Thus, an apparatus and method for a fast heat rise resistor using resistive foil with photolithographic production has been disclosed which solves problems and deficiencies in the art. It will be readily apparent to those skilled in the art that different types of substrates and types of foil may be used in the foil resistor. It will also be clear to those skilled in the art that different materials, dimensions, and other variations may be used including different types of foil, different thicknesses and widths of foil, different thicknesses of plating, different lengths of foil, different films in place of capton, and other variations as required by particular applications and environments.

It is therefore seen that this invention will achieve at least all of its stated objectives.

What is claimed is:

1. A method of manufacturing vehicle air bags comprising:

providing a deflated vehicle air bag;

providing an explosive material suitable for inflating the air bag;

providing a foil resistor bridge affixed to a substrate, the bridge having an elevated portion and a contact portion, the elevated portion being located adjacent the substrate, the contact portion being in contact with the substrate and removing a layer of film located between the substrate and the elevated position of the foil resistor bridge;

positioning the explosive material adjacent to the foil resistor bridge;

providing a foil resistor bridge affixed to a substrate, the bridge having an elevated portion and a contact portion, said elevated portion above the substrate, said contact portion in contact with said substrate;

positioning the explosive material adjacent to the foil resistor bridge; and providing an electrical connection to the foil resistor bridge capable of delivering electrical energy to the foil resistor bridge.

2. The method of claim 1 wherein the step of positioning the explosive material adjacent to the foil resistor bridge includes positioning the explosive material between the substrate and the foil resistor bridge.

3. The method of claim 1 wherein the step of providing an explosive material further includes:

providing a first pyrotechnic material capable of creating a first explosion;

providing a second gas-generating pyrotechnic material suitable for inflating the air bag, the first explosion capable of igniting the second pyrotechnic material.

4. The method of claim 1 wherein the film is capton.

5. The method of claim 1 wherein the explosive material is liquid.

6. The method of claim 1 wherein the explosive material is pressed powder.

* * * * *